US011339044B1

(12) United States Patent
Qin et al.

(10) Patent No.: US 11,339,044 B1
(45) Date of Patent: May 24, 2022

(54) WINE TAKING DEVICE USED IN WINE FRESH-KEEPING DEVICE

(71) Applicant: Yingjia Technology (Shenzhen) Co., Ltd, Guangdong (CN)

(72) Inventors: Zhongshu Qin, Guangdong (CN); Cuiting Chen, Guangdong (CN)

(73) Assignee: Yingjia Technology (Shenzhen) Co., Ltd, Shenzhen (CN)

( * ) Notice: Subject to any disclaimer, the term of this patent is extended or adjusted under 35 U.S.C. 154(b) by 0 days.

(21) Appl. No.: 17/228,738

(22) Filed: Apr. 13, 2021

(30) Foreign Application Priority Data

Mar. 11, 2021 (CN) ..... 202110268440.5

(51) Int. Cl.
*B67D 1/00* (2006.01)
*B67D 1/04* (2006.01)
*B67D 1/08* (2006.01)

(52) U.S. Cl.
CPC ..... *B67D 1/0004* (2013.01); *B67D 1/0412* (2013.01); *B67D 1/0802* (2013.01); *B67D 1/0885* (2013.01); *B67D 2001/0093* (2013.01); *B67D 2001/0812* (2013.01)

(58) Field of Classification Search
CPC .. B67D 1/0004; B67D 1/0412; B67D 1/0802; B67D 1/0885; B67D 2001/0093; B67D 2001/0812; B67D 1/04; B67D 1/0869; B67D 1/0888; B67D 1/0895; B67D 1/10; B67D 1/1252; B67D 2001/0092; B67D 2001/0481; B67D 2001/0814; B67D 2001/082; B67D 2210/00031; B01F 3/04794; B01F 2215/0072; B67B 7/0405; B67B 7/0441
See application file for complete search history.

(56) References Cited

U.S. PATENT DOCUMENTS

2003/0213814 A1* 11/2003 Phelps ..... B67D 1/04 222/146.6
2008/0054015 A1* 3/2008 Moezidis ..... B67D 1/06 222/1
2010/0005811 A1* 1/2010 Jaffe ..... B67D 1/0412 62/3.64
2011/0253746 A1* 10/2011 O'Keefe, Jr. ..... B67D 1/0005 222/132
2012/0080445 A1* 4/2012 Moezidis ..... F25D 31/007 222/1
2014/0144935 A1* 5/2014 O'Keefe, Jr. ..... B67D 1/0004 222/23
2016/0175781 A1* 6/2016 Hubbard, Jr. ..... B67D 1/0004 261/77

* cited by examiner

*Primary Examiner* — Donnell A Long

(57) ABSTRACT

A wine taking device used in a wine fresh-keeping device may be shown and described. A first pipe, the first end of the first pipe is connected with the fresh-keeping gas storage tank, a first solenoid valve, a first end of the first solenoid valve is connected to a second end of the first pipe, a second pipe, the first end of the second pipe is connected to a second end of the first solenoid valve, a three-way valve, a first end of the three-way valve is connected to a second end of the second pipe, a second solenoid valve, a first end of the second solenoid valve is connected to a second end of the three-way valve, and a second end of the second solenoid valve is provided with a hollow needle used to reach into the wine bottle to take wine, and connected to the second solenoid valve.

4 Claims, 9 Drawing Sheets

WINE TAKING DEVICE USED IN WINE FRESH-KEEPING DEVICE

CROSS-REFERENCES TO RELATED APPLICATIONS

The present patent application claims benefit and priority to Chinese Patent Application No. 2021102684405, entitled "Wine fresh-keeping device", filed on Mar. 11, 2021, which are hereby incorporated by reference into the present disclosure.

FIELD OF THE APPLICATION

The present application relates to the field of mechanical structures, in particular to a wine taking device used in a wine fresh-keeping device.

BACKGROUND wine is an indispensable element in people's lives nowadays, but if some of the precious alcoholic beverages on the market are not consumed in time after opening, its preservation is a big problem.

At present, the technology of preservation of wines on the market is generally refrigerated. It is very troublesome to take out and drink every time. Moreover, once opened, the sealing effect cannot be comparable to that of the original factory, which will cause the taste of the wine to change.

Therefore, there is an urgent need for a wine fresh-keeping device that can solve one or more of the above-mentioned problems.

BRIEF SUMMARY OF THE DISCLOSURE

A wine taking device used in a wine fresh-keeping device may be shown and described. A first pipe, the first end of the first pipe is connected with the fresh-keeping gas storage tank, a first solenoid valve, a first end of the first solenoid valve is connected to a second end of the first pipe, a second pipe, the first end of the second pipe is connected to a second end of the first solenoid valve, a three-way valve, a first end of the three-way valve is connected to a second end of the second pipe, a second solenoid valve, a first end of the second solenoid valve is connected to a second end of the three-way valve, and a second end of the second solenoid valve is provided with a hollow needle used to reach into the wine bottle to take wine, and connected to the second solenoid valve.

BRIEF DESCRIPTION OF THE DRAWINGS

Advantages of embodiments of the present invention will be apparent from the following detailed description of the exemplary embodiments thereof, which description should be considered in conjunction with the accompanying drawings in which like numerals indicate like elements, in which.

DETAILED DESCRIPTION

Figure 1:
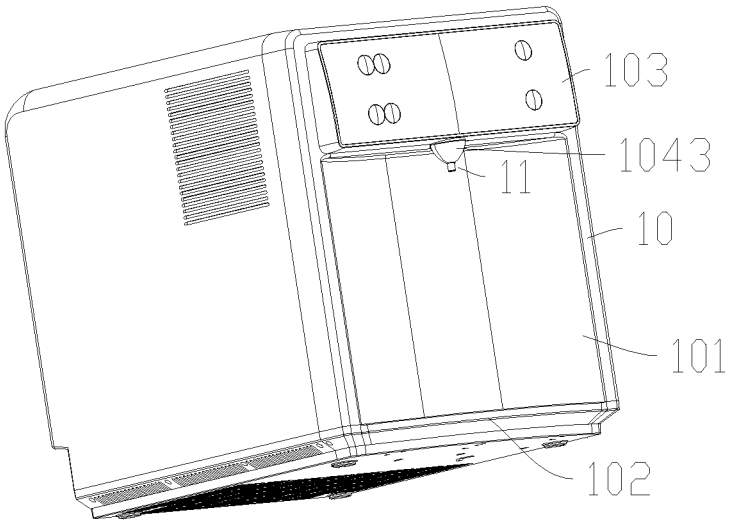
FIG. 1 is a schematic diagram of a structure of a wine fresh-keeping device according to the present invention.
Figure 2:
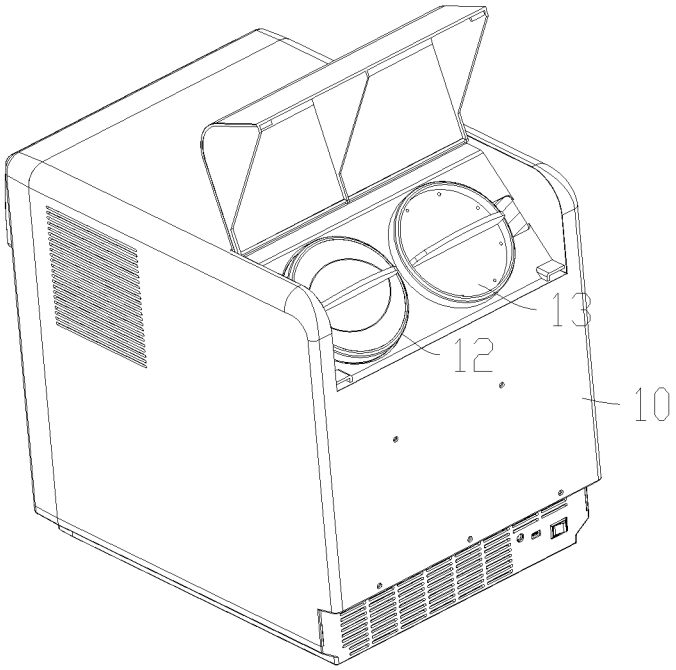
FIG. 2 is a schematic structural diagram from another angle of the wine fresh-keeping device according to the present invention.
Figure 3:
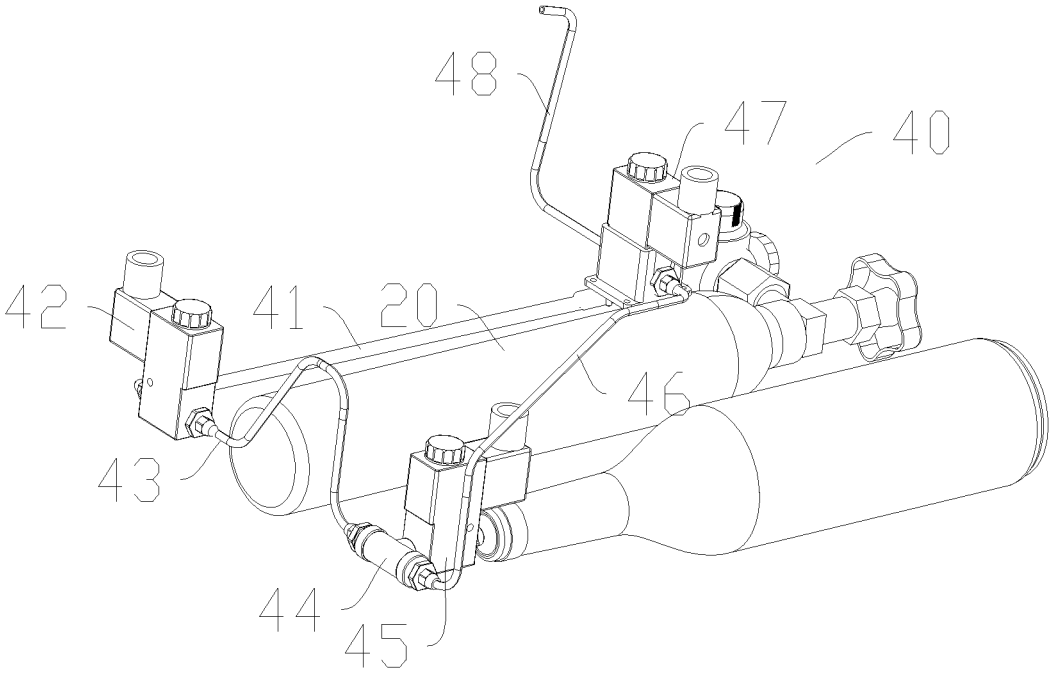
FIG. 3 is a schematic diagram of the structure of a wine taking device used in wine fresh-keeping device in the wine fresh-keeping device according to the present invention.
Figure 4:
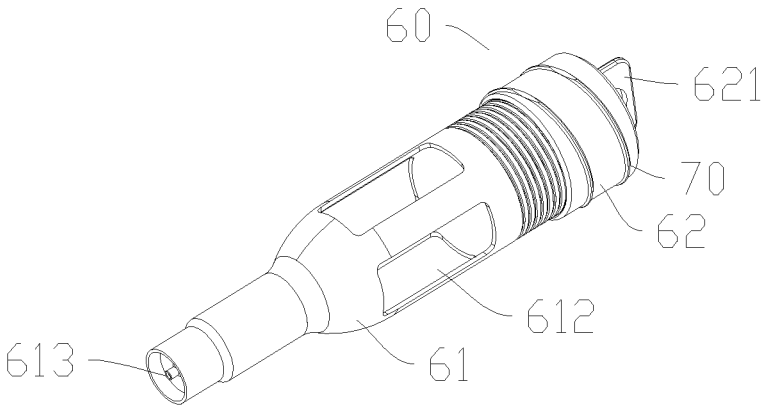
FIG. 4 is a schematic diagram of the structure of a wine sleeve in the wine fresh-keeping device according to the present invention.
Figure 5:
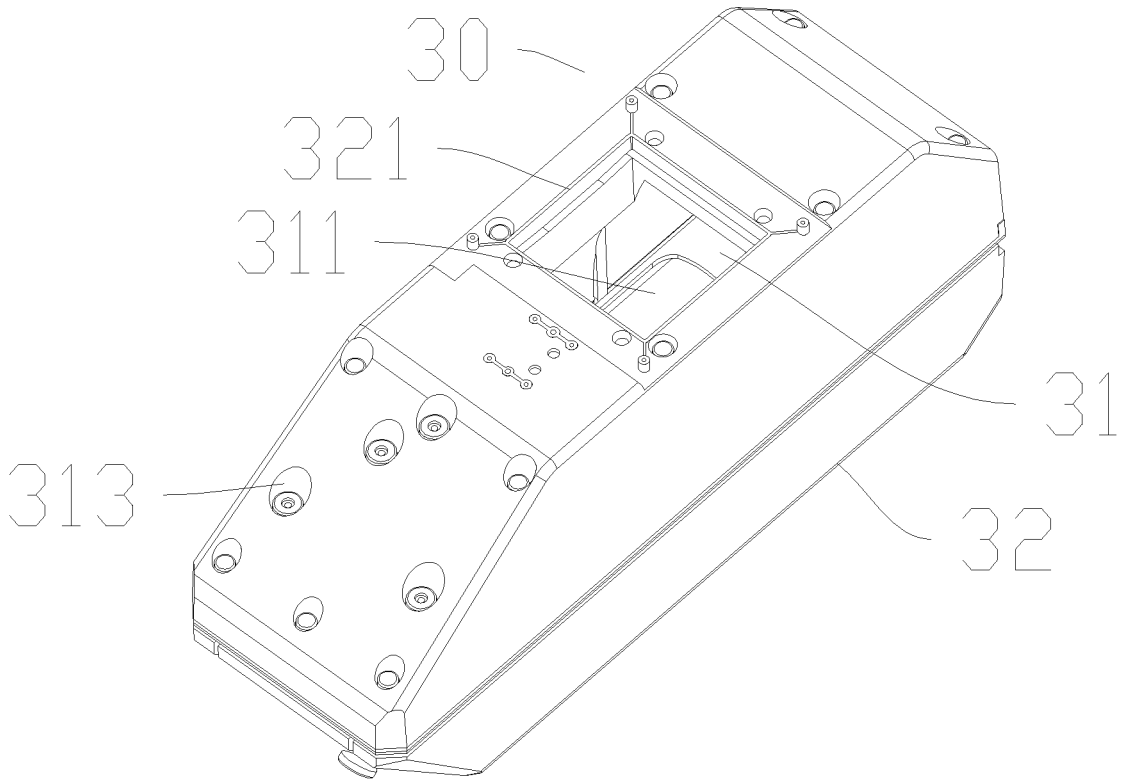
FIG. 5 is a schematic structural diagram of a wine bottle installation chamber in the wine fresh-keeping device according to the present invention.
Figure 6:
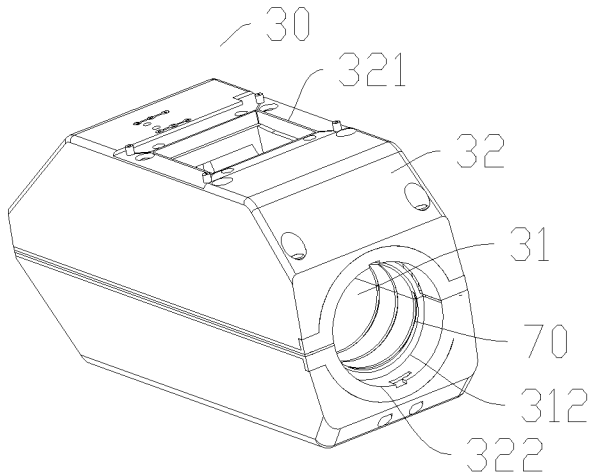
FIG. 6 is a schematic structural view from another angle of the wine bottle installation chamber in the wine fresh-keeping device according to the present invention.
Figure 7:
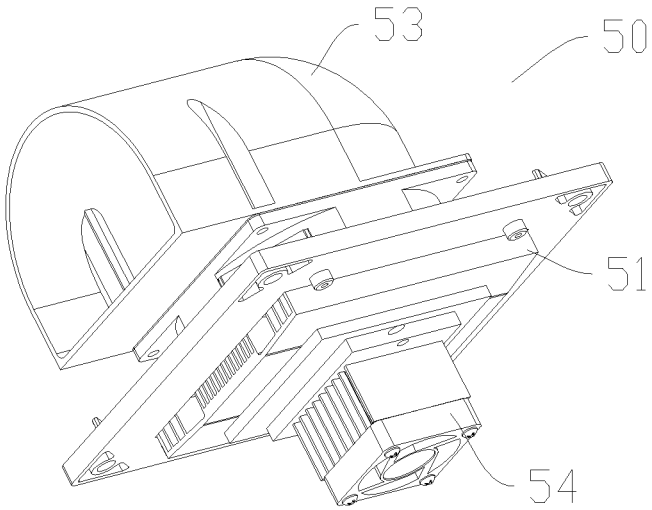
FIG. 7 is a schematic structural diagram of a refrigeration device in the wine fresh-keeping device according to the present invention.
Figure 8:
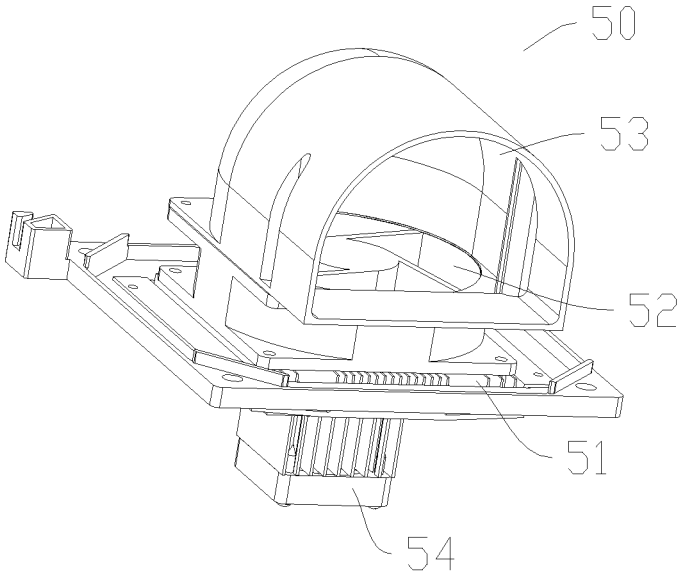
FIG. 8 is a schematic structural view of another angle of the refrigeration device in the wine fresh-keeping device according to the present invention.
Figure 9:
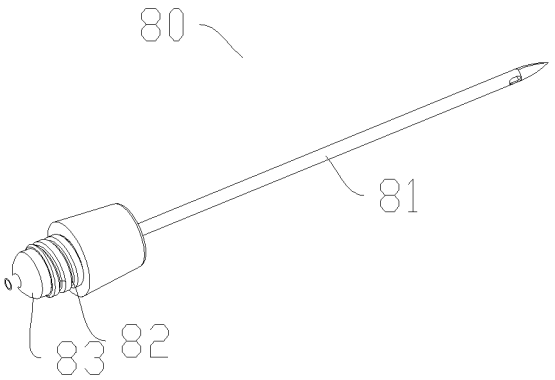
FIG. 9 is a schematic structural diagram of a hollow needle in the wine fresh-keeping device according to the present invention.
Figure 10:
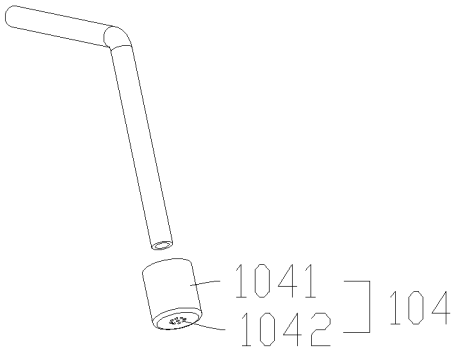
FIG. 10 is a schematic diagram of the structure of a wine-dispensing accessory in the wine fresh-keeping device according to the present invention.
Figure 11:
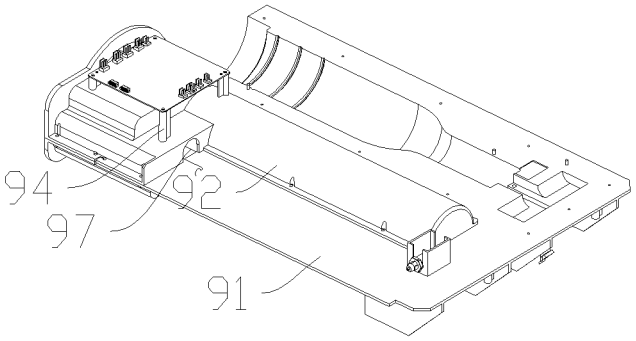
FIG. 11 is a schematic structural diagram of an installation structure of a fresh-keeping gas storage tank in the wine fresh-keeping device according to the present invention.
Figure 12:
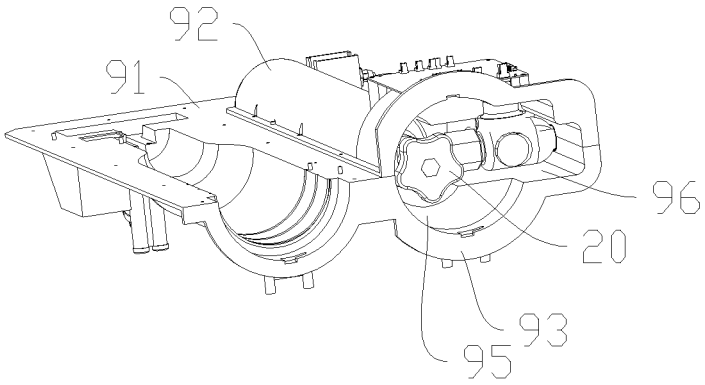
FIG. 12 is a schematic structural view from another angle of the installation structure of the fresh-keeping gas storage tank in the wine fresh-keeping device according to the present invention.
Figure 13:
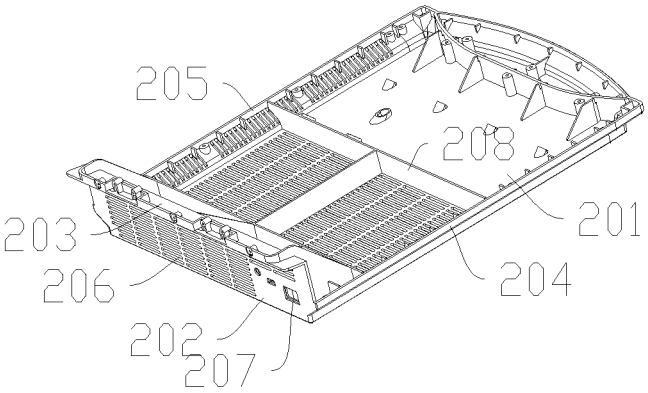
FIG. 13 is a schematic structural diagram of a heat dissipation bottom plate in the wine fresh-keeping device according to the present invention.

In order to make the above-mentioned objects, features and advantages of the present invention more simple and understandable, the specific embodiments of the present invention will be described in detail below with reference to the accompanying drawings. In the following description, many specific details are explained in order to fully understand the present invention. However, the present invention can be implemented in many other ways different from those described herein, and those skilled in the art can make similar improvements without departing from the connotation of the present invention. Therefore, the present invention is not limited by the specific embodiments disclosed below.

Referring to FIGS. 1 to 13, the disclosure is a wine fresh-keeping device, the device for preserving alcoholic beverages includes:

A housing 10, the housing 10 is provided with a wine outlet 11 for taking out wine, and an exchange port 12 for exchanging items inside and outside the housing 10, and a sealing cover 13 is provided at the exchange port 12, a containing chamber is formed inside the housing 10, A fresh-keeping gas storage tank 20, the fresh-keeping gas storage tank 20 is arranged in the containing chamber, and one end of the fresh-keeping gas storage tank 20 is matched with the exchange port 12, and it is replaced through the exchange port 12, A wine bottle installation chamber 30, the wine bottle installation chamber 30 is arranged in the containing chamber, and one end of the wine bottle installation chamber 30 is matched with the exchange port 12, and the wine bottle inside is replaced through the exchange port 12, A wine taking device used in wine fresh-keeping device 40, the wine taking device used in wine fresh-keeping device 40 is arranged in the housing 10 and connected to the fresh-keeping gas storage tank 20, and A refrigeration device, the refrigeration device 50 is arranged on the housing 10 and cools the wine installation chamber.

Specifically, this embodiment is suitable for the preservation of high-end red wine, white wine and the like. When in use, install the red wine or white wine in the wine bottle installation chamber 30, and take a small amount of wine through the wine taking device used in wine fresh-keeping device 40. At the same time, the wine bottle after taking the wine is filled with a preservation gas for preservation. Generally, argon is used. In this process, the refrigeration device 50 is also needed to cool the wine bottle installation chamber 30, and double preservation is achieved by refrigeration and argon flushing.

The wine taking device used in wine fresh-keeping device 40 includes:

A first pipe 41, the first end of the first pipe 41 is connected with the fresh-keeping gas storage tank 20, A first solenoid valve 42, a first end of the first solenoid valve 42 is connected to a second end of the first pipe 41, A second pipe 43, the first end of the second pipe 43 is connected to a second end of the first solenoid valve 42, A three-way valve 44, a first end of the three-way valve 44 is connected to a second end of the second pipe 43, A second solenoid valve 45, a first end of the second solenoid valve 45 is connected to a second end of the three-way valve 44, and a second end of the second solenoid valve 45 is provided with a single-channel hollow needle used to reach into the wine bottle to take wine, and connected to the second solenoid valve 45, A third pipe 46, a first end of the third pipe 46 is connected to a third end of the three-way valve 44, A third solenoid valve 47, a first end of the third solenoid valve 47 is connected to a second end of the third pipe 46, and A fourth pipe 48 has a first end of the fourth pipe is connected to a second end of the third solenoid valve 47, and a second end of the fourth pipe 48 is connected to the wine outlet 11.

Specifically, in the process of taking wine, we generally first open the fresh-keeping gas storage tank 20, and at the same time open the first solenoid valve 42, the second solenoid valve 45, and close the third solenoid valve 47. At this time, we are filled with argon gas into the wine through the first pipe 41 and the second pipe 43. Because the hollow needle is a single-channel design, this makes the wine in the wine bottle unable to flow out of the wine bottle through the hollow needle during the process of filling the argon gas. When the incoming argon reaches the set threshold, the air pressure in the wine bottle will be much higher than the atmospheric pressure. At this time, close the fresh-keeping gas storage tank 20 and the first solenoid valve 42, and open the third solenoid valve 47. Under the action of the air pressure difference, the wine in the wine bottle is pressed out into the third pipe 46 through the single channel of the hollow needle, and flows out from the fourth pipe 48 through the third solenoid valve 47, and the user can carry out the operation of taking wine through entering the wine outlet 11.

When the wine is finished, we can close the second solenoid valve 45, open the fresh-keeping gas storage tank 20 and the first solenoid valve 42. At this time, the first pipe 41, the second pipe 43, the third pipe 46 and the fourth pipe 48 are flushed, the residual liquid in them is flushed out from the wine outlet 11, and the first pipe 41, the second pipe 43, the third pipe 46 and the fourth pipe 48 are kept clean.

After the rinsing is completed, the fresh-keeping gas storage tank 20, the first solenoid valve 42 and the third solenoid valve 47 are closed to complete a cycle of wine fetching and rinsing.

In some embodiments, the wine bottle installation chamber 30 is also provided with a wine sleeve 60 that matches with the wine bottle, and a cooperating movement threads 70 is provided between outer side wall of the wine sleeve 60 and inner side wall of the wine bottle installation chamber 30, When the wine sleeve 60 is rotated, the wine sleeve 60 moves downward along the wine bottle installation chamber 30 under the cooperation of the cooperating movement threads 70.

Specifically, in this embodiment, the wine sleeve 60 is designed outside the wine bottle, and the cooperating movement threads 70 is designed between the wine sleeve 60 and the wine bottle installation chamber 30, which makes the wine bottle move downward in the wine bottle installation chamber 30 In this process, the cork of the wine bottle first contacts with the hollow needle, and then the wine bottle rotates through the rotation of the wine sleeve 60, so that the needle is smoothly inserted into the wine bottle, which greatly facilitates the hollow needle to insert the bottle pass through the cork.

In some embodiments, the wine sleeve 60 includes:

A first sleeve 61, the first sleeve 61 is provided with a first opening (not shown in the figure) that allows the wine bottle to enter, at least one of a second opening 612 of which enables the wine bottle to communicate with the wine bottle installation chamber 30, and a third opening 613 through which a hollow needle 80 is inserted, and A second sleeve 62, the second sleeve 62 is matched with the first opening (not shown in the figure) of the first sleeve 61 to fix the wine bottle in the first sleeve 61, and the tail of the second sleeve 62 is provided with a force applying portion 621 that is convenient for the human to apply force, The cooperating movement threads 70 is arranged between the second sleeve 62 and the wine bottle installation chamber 30.

Specifically, in this embodiment, the wine sleeve 60 is designed as the design of the first sleeve 61 and the second sleeve 62, which greatly facilitates the fixing of the wine bottle. At the same time, the first sleeve 61 and the second sleeve 62 are also fixed by threads, and the second sleeve 62 has a certain length. During use, if the wine bottle is short, then we can change the second sleeve 62 is screwed into the depth of the outer side of the first sleeve 61 to lengthen until the second sleeve 62 is in contact with the bottom of the wine bottle to realize the fixation of the wine bottle, when the wine bottle is longer, then we can screw the second sleeve 62 into The outer depth of the first sleeve 61 is reduced until the second sleeve 62 contacts the bottom of the wine bottle to realize the fixation of the wine bottle. This design can make the wine sleeve 60 suitable for wine bottles of different lengths.

In some embodiments, the wine bottle installation chamber 30 includes:

An inner cavity 31, the inside of the inner cavity 31 matches the shape of the wine sleeve 60, and a fourth opening 311 that allows the wine sleeve 60 to communicate with the outer cavity, and a fifth opening 312 that allows the wine sleeve 60 to enter, and An outer cavity 32, the outer cavity 32 is fixedly arranged outside the inner cavity 31, a gap is formed between the inner cavity 31 and the outer cavity 32, the outer cavity 32 is also provided with a sixth opening 321 matched with the refrigeration device 50 and a seventh opening 322 matched with the fifth opening 312.

In some embodiments, the inner cavity 31 and the outer cavity 32 are provided with routing holes 313 for facilitating the routing of the first pipe 41, the second pipe 43, the third pipe 46, and/or the fourth pipe 48.

Specifically, the wine bottle installation chamber 30 adopts the design of the inner cavity 31 and the outer cavity 32. Through the inner cavity 31, the wine sleeve 60 rotates and moves downward, so that the hollow needle 80 can pass through the wine cork, through the design of the outer cavity 32, a gap is formed between the outer cavity 32 and the inner cavity 31, which is isolated from the housing chamber of the housing 10, which makes the refrigeration device 50 only need to cool the gap during the cooling process, which greatly reduces energy consumption.

In some embodiments, the refrigeration device 50 includes:

A semiconductor refrigeration chip 51, the semiconductor refrigeration chip 51 is fixedly arranged on the wine bottle installation chamber 30, and the cooling surface of the semiconductor refrigeration chip 51 is in communication with the wine bottle installation chamber 30, A heat exhaust fan 52, which is arranged at the heating surface of the semiconductor refrigeration chip 51 for accelerating the heat dissipation of the heating surface of the semiconductor refrigeration chip 51, and An air guide channel 53 is arranged between the wine bottle installation chamber 30 and the housing 10 and is used to conduct heat to the outside of the housing 10.

In some embodiments, the refrigeration device 50 further includes:

A stirring fan 54 is arranged at the cooling surface of the semiconductor refrigeration chip 51, and is used to agitate the cold air at the cooling surface of the semiconductor refrigeration chip 51 in the wine bottle installation chamber 30.

Specifically, this embodiment also designs the refrigeration device 50. The refrigeration device 50 uses a semiconductor refrigeration chip 51 to cool, and the refrigerating surface is designed in the wine bottle installation chamber 30 to cool the wine bottle installation chamber 30. At the same time, the heating surface quickly sends heat to the housing 10 through the heat exhaust fan 52, so that the cooling of the wine bottle installation chamber 30 is realized.

At the same time, in order to speed up the cooling effect in the wine bottle installation chamber 30, this embodiment also designs the stirring fan 54 at the cooling surface to quickly reduce the temperature in the gap and accelerate the cooling effect of the gap.

In some embodiments, a filter plate (not shown in the figure) is further provided at the outlet of the air guide channel 53.

It should also be noted that, in order to avoid the accumulation of dust in the wine bottle installation chamber 30, this embodiment also designs a filter plate (not shown in the figure) at the outlet of the air guide channel 53 to perform the dust in the air. filter.

In some embodiments, the hollow needle 80 includes:

A needle body 81, a hollow channel inside the needle body 81, and

A threaded connector 82 is fixedly arranged at the bottom of the needle body 81 and is fixedly connected to the needle body 81 for threaded connection with the second end of the second solenoid valve 45.

In some embodiments, the hollow needle 80 further includes:

A first sealing ring 83 is arranged at the lower end of the threaded connector 82 and is used for sealing between the needle body 81 and the second solenoid valve 45.

This embodiment also proposes a fresh-keeping gas storage tank installation structure for a wine fresh-keeping device, and the fresh-keeping gas storage tank installation structure includes:

A lower shell 91 of the fresh-keeping gas storage tank, and

An upper shell 92 of the fresh-keeping gas storage tank, between upper shell 92 of the fresh-keeping gas storage tank and the lower shell 91 of the fresh-keeping gas storage tank, a fresh-keeping gas storage tank installation chamber for accommodating the fresh-keeping gas storage tank 20 is formed, After the lower shell 91 of the fresh-keeping gas storage tank and the upper shell 92 of the fresh-keeping gas storage tank are fixedly installed, there is an opening of fresh-keeping gas storage tank 93 for the fresh-keeping gas storage tank 20 to enter, The upper shell 92 of the fresh-keeping gas storage tank is provided with a installation hole 94 for mounting the control main board.

Specifically, in this embodiment, an installation hole 94 is designed on the upper shell 92 of the fresh-keeping gas storage tank, which facilitates the installation of the control main board and greatly increases the compactness of the overall structure.

In some embodiments, the fresh-keeping gas storage tank installation chamber includes:

A first chamber 95 that cooperates with the fresh-keeping gas storage tank 20, and A second chamber 96, the second chamber 96 is communicated with the first chamber 95, and the second chamber 96 is matched with a pressure gauge, The bottom of the second chamber 96 is provided with a first pipe inlet and outlet 97.

Specifically, this embodiment adopts the design of the first chamber 95 and the second chamber 96. When the fresh-keeping gas storage tank 20 needs to be replaced, the fresh-keeping gas storage tank 20 and the pressure gauge can be directly taken out for replacement, which is quite convenient.

In some embodiments, a sealing cover 13 is also provided at the opening of the fresh-keeping gas storage tank 93.

In some embodiments, the sealing cover 13 is threadedly connected with the opening of the fresh-keeping gas storage tank 93.

In some embodiments, the lower shell 91 of the fresh-keeping gas storage tank and the upper shell 92 of the fresh-keeping gas storage tank are arranged obliquely.

Specifically, the inclined design is compared with the vertical design. When the vertically arranged the fresh-keeping gas storage tank 20 is replaced, the fresh-keeping gas storage tank 20 needs to be lifted vertically, and the gravity of the entire fresh-keeping gas storage tank 20 needs to be overcome, and the inclined design, the inclined surface can offset most of the gravity, which greatly facilitates the replacement of the fresh-keeping gas storage tank 20.

Compared with the horizontal design, although the horizontal design can basically ignore the gravity of the fresh-keeping gas storage tank 20, it needs to be squatted to replace when it is replaced, which is more inconvenient to replace.

This embodiment also proposes a wine tapping panel structure for a wine fresh-keeping device, and the wine tapping panel structure includes:

Panel body 101,

A container holder 102, which is arranged on the bottom side of the panel body 101, A control panel 103, the control panel 103 is arranged on the top side of the panel body 101 and on the same side as the container holder 102, and The wine outlet 11 is arranged at the lower end of the control panel 103 and is matched with the container holder 102, The wine outlet 11 is provided with a wine dispensing accessory 104 for evenly dispensing wine.

In some embodiments, the wine-dispensing accessory 104 includes:

A wine-dispensing accessory body 1041, the wine-dispensing accessory body 1041 is provided with a blind hole (not shown in the figure) that matches with the wine outlet 11, and The split hole group 1042 is uniformly arranged at the bottom of the blind hole (not shown in the figure) and matched with the wine outlet 11.

Specifically, because the device uses the pressure difference between the inside and outside of the wine bottle to press out the wine in the wine bottle when taking wine, in this process, the wine that is flushed out of the wine outlet 11 will have a greater pressure, this will cause the problem of splashing of the wine. In this solution, a wine-dispensing accessory 104 is designed at the wine outlet 11, so that the wine coming out is first buffered by the wine-dispensing accessory 104, and then passes through the split hole group 1042 on the wine-dispensing accessory 104 flows out, which greatly reduces the speed of the wine from the wine outlet 11 and avoids the problem of splashing of the wine.

In some embodiments, the wine outlet 11 is also provided with a wine outlet mounting seat 1043.

This embodiment also discloses a heat-dissipating bottom plate for a wine fresh-keeping device, the heat-dissipating bottom plate comprising:

bottom plate body 201,

A first vertically extending plate 202, the first vertically extending plate 202 is arranged on one side of the bottom plate body 201 and extends upward, A second laterally extending plate 203, the second laterally extending plate 203 is disposed on the upper end surface of the first vertically extending plate 202 and extends in a direction away from the bottom plate body 201, A third extension plate 204, the third extension plate 204 is arranged on the other side of the bottom plate body 201, and one side is connected with the first vertically extending plate 202, and A fourth extension plate 205, the fourth extension plate 205 is arranged on the other side of the bottom plate body 201, and one side is connected with the first vertically extending plate 202, The bottom plate body 201, the first vertically extending plate 202, the third extension plate 204 and the fourth extension plate 205 are provided with a plurality of heat dissipation through holes 206.

Specifically, the heat dissipation bottom plate is provided with a number of heat dissipation through holes 206 on the first vertically extending plate 202, the third extension plate 204, and the fourth extension plate 205, which greatly accelerates the air convection inside and outside the housing 10 and accelerates heat dissipation.

In some embodiments, the third extension plate 204 and the fourth extension plate 205 are respectively arranged obliquely, and they are respectively inclined in a direction away from the bottom plate body 201.

In some embodiments, a plurality of wire routing holes 207 are provided on the back of the second laterally extending plate 203.

Specifically, a wire routing hole 207 is designed on the back of the second laterally extending plate 203, and a gap is left between the second laterally extending plate 203 and the first vertically extending plate 202, which when the device is placed against a wall, There will be no gap between the device and the wall due to the wires running on the back, and at the same time, the problem of excessive squeezing and friction between the wires running on the back and the wall, causing damage to the wires.

In some embodiments, at least one reinforcing rib 208 is provided on the bottom plate body 201.

Figure 14:
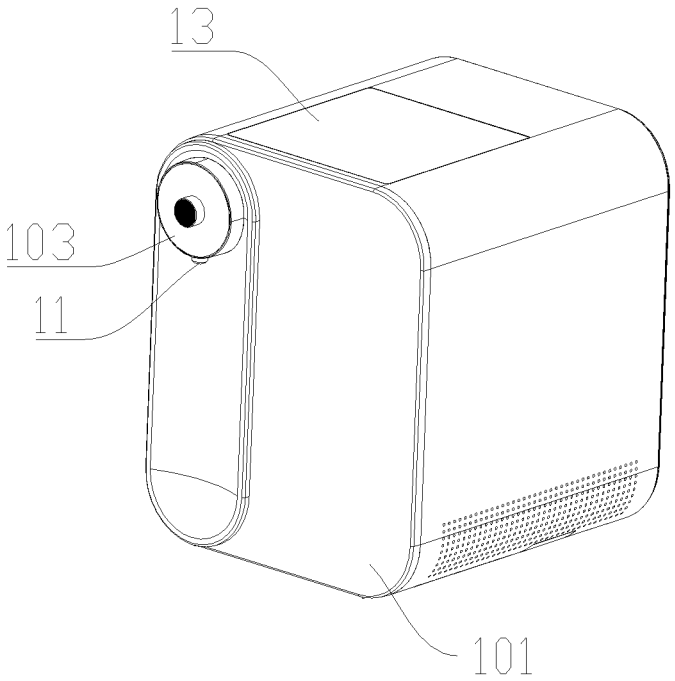
FIG. 14 is a schematic diagram of a structure of the wine fresh-keeping device according to another embodiment of the present invention.
Figure 15:
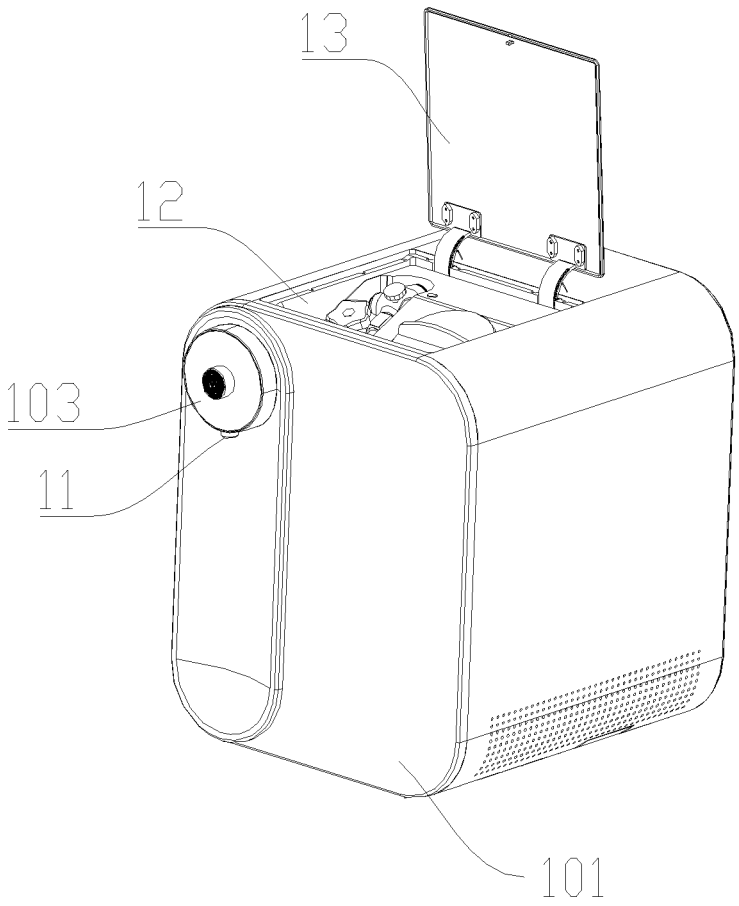
FIG. 15 is a schematic structural diagram of an open state of the sealing cover of the wine fresh-keeping device according to another embodiment of the present invention.

FIG. 14 and FIG. 15, the present invention also proposes a wine fresh-keeping device. The exchange port 12 of the wine fresh-keeping device is arranged on the side close to the panel body 101. When the wine fresh-keeping device is rotated, it is convenient to take and place the fresh-keeping gas storage tank and the wine bottle.

The above-mentioned embodiments only express two embodiments of the present invention, and their description is more specific and detailed, but they should not be understood as a limitation on the scope of the invention patent. It should be pointed out that for those of ordinary skill in the art, without departing from the concept of the present invention, several modifications and improvements can be made, and these all fall within the protection scope of the present invention. Therefore, the protection scope of the patent of the present invention should be subject to the appended claims.

What is claimed is:

1. A wine taking device, comprising:

a first pipe, a first end of the first pipe is connected with a fresh-keeping gas storage tank, a first solenoid valve, a first end of the first solenoid valve is connected to a second end of the first pipe, a second pipe, the first end of the second pipe is connected to a second end of the first solenoid valve, a three-way valve, a first end of the three-way valve is connected to a second end of the second pipe, a second solenoid valve, a first end of the second solenoid valve is connected to a second end of the three-way valve, and a second end of the second solenoid valve is provided with a single-channel hollow needle for reaching into the wine bottle to take wine, and connected to the second solenoid valve, a third pipe, a first end of the third pipe is connected to a third end of the three-way valve, a third solenoid valve, a first end of the third solenoid valve is connected to a second end of the third pipe, and a fourth pipe, a first end of the fourth pipe is connected to a second end of the third solenoid valve, and a second end of the fourth pipe is connected to a wine outlet.

2. The wine taking device of claim 1, wherein the hollow needle comprises:

a needle body, a hollow channel inside the needle body, and a threaded connector fixedly arranged at the bottom of the needle body and fixedly connected to the needle body for threaded connection with the second end of the second solenoid valve.

3. The wine taking device of claim 2, wherein the hollow needle comprises:

a first sealing ring arranged at the lower end of the threaded connector for sealing between the needle body and the second solenoid valve.

4. The wine taking device of claim 2, wherein one end of the needle body is provided with a first pinhole communicating with the hollow channel, and an other end is provided with two second pinholes communicating with the hollow channel.

* * * * *